US007712161B2

(12) United States Patent
Reynolds, II

(10) Patent No.: US 7,712,161 B2
(45) Date of Patent: May 11, 2010

(54) COMBINATION SPA SYSTEM WITH WATER CHILLING ASSEMBLY

(76) Inventor: Charles W. Reynolds, II, 801 S. 25th Ave., Phoenix, AZ (US) 85009

( * ) Notice: Subject to any disclaimer, the term of this patent is extended or adjusted under 35 U.S.C. 154(b) by 232 days.

(21) Appl. No.: 11/401,752

(22) Filed: Apr. 11, 2006

(65) Prior Publication Data

US 2006/0288476 A1 Dec. 28, 2006

Related U.S. Application Data

(60) Provisional application No. 60/684,674, filed on May 26, 2005.

(51) Int. Cl.
*A47K 3/00* (2006.01)
*A47K 3/10* (2006.01)

(52) U.S. Cl. ..... 4/541.1; 601/166

(58) Field of Classification Search ..... 4/493, 4/506, 541.1, 545, 584, 592, 593; 601/157, 601/166; 607/85, 86
See application file for complete search history.

(56) References Cited

U.S. PATENT DOCUMENTS 3,272,201 A * 9/1966 Burns ..... 601/166
3,837,016 A 9/1974 Schindler et al.
3,943,580 A 3/1976 Carter
4,047,522 A * 9/1977 Plugge ..... 4/541.4
4,761,838 A * 8/1988 Hargrove ..... 4/541.2
4,930,168 A 6/1990 Ferlise
5,241,958 A 9/1993 Noeldner
5,287,567 A 2/1994 Eash et al.
5,465,588 A * 11/1995 McCahill et al. ..... 62/127
6,349,427 B1 * 2/2002 Bergstrom ..... 4/541.1
6,425,999 B1 7/2002 Huang
6,640,352 B2 11/2003 Huang
6,939,366 B2 * 9/2005 Brown, Jr. ..... 607/95

* cited by examiner

*Primary Examiner*—Tuan N Nguyen
(74) *Attorney, Agent, or Firm*—Parsons & Goltry; Michael W. Goltry; Robert A. Parsons

(57) ABSTRACT

A spa system includes a tub supported by a chassis, an enclosed space formed between the tub and the chassis, first and second vents through the chassis leading to the enclosed space, water heating and cooling devices coupled in series to a circulating system adapted to withdraw and return water relative to the tub, and a thermostat operatively coupled to the heating and cooling devices. The cooling device incorporates a fan operative for drawing air into the enclosed space through the first vent in response to activation of the cooling device, and a blower is operative for expelling air from the enclosed space through the second vent currently with the operation of the fan of the cooling device.

20 Claims, 11 Drawing Sheets

COMBINATION SPA SYSTEM WITH WATER CHILLING ASSEMBLY

CROSS-REFERENCE TO RELATED APPLICATION

This application claims the benefit of U.S. Provisional Patent Application Ser. No. 60/684,674, filed 26 May 2005.

FIELD OF THE INVENTION

The present invention relates to spas and hot tubs.

BACKGROUND OF THE INVENTION

For many years, hot tubs and home spas were the exclusive luxuries of the wealthy. They were expensive to buy, expensive to operate, and not entirely reliable. With the onset of better manufacturing techniques, improved materials, and lower prices, however, the popularity of hot tubs and home spas has soared, particularly throughout the last decade.

History provides many examples of hot tubs or spas. For instance, the Romans were known to have used bathhouses, which became centers of social life and a common daily activity for the elite classes. Other cultures made use of spa-like hot baths as well, including the ancient peoples of China and Japan.

Some of the earliest spa enthusiasts appreciated the health benefits of using hot water to relax the body, open the pores of the skin, and generally promote better health. Cleanliness was considered healthful and a sign of prosperity. As medical science has advanced, there has been an increased awareness of the benefits of hot tub hydrotherapy. Many medical conditions, injuries and other health problems can be eased or improved with regular hydrotherapy treatments. For example, people with arthritis, multiple sclerosis, paralysis and other conditions that involve deteriorating range of motion benefit from time spent in a hot tub. The warm water helps ease aches and pains, while loosening joints and making them easier to move and keep mobile. Joint problems, chronic back pain and other painful conditions resulting from injuries are also helped with regular hot tub hydrotherapy. Those seeking stress relief, general relaxation, and quiet opportunities for conversation commonly experience significant hot tub benefits as well.

Modern technology, materials and production processes make it possible to design and build home spas and hot tubs with highly specialized hydrotherapy features. These features are typically based on a combination of seating position, jet position and jet function.

Traditional hot tub seating was bench-style, typically in a round shape and at a uniform depth so that everyone sat at the same level in the tub. This made it challenging for people of different heights to fully benefit from hot tub therapy. With the development of molded fiberglass spa shells came the development of different shapes and sizes of seats. Manufacturers began to include lounge seats, where the bather reclines in the water, as well as seats to accommodate bathers of different heights. Some also included deeper seats, designed to fully immerse the bather and allow placement of jets in specific positions for specific benefits.

Moldable shell manufacturing made it possible for the first time to place jets in nearly any position within the tub. Manufacturers began experimenting with placing jets in places where they would focus on specific areas of the body, such as the back, neck, shoulders, arms and legs.

The earliest jets were single-action nozzles with limited ability to adjust where they were aimed or the intensity of the jet action. This made it difficult to use them in positions where they would affect more tender areas of the body, such as wrists, forearms, ankles, feet and knees. As manufacturers developed more advanced jets with a wider variety of functionality, though, the technology of hydrotherapy advanced significantly. Modern hot tubs and spas can be customized with a surprising variety of jets that range from multi-purpose to highly specialized. Buyers often are able to select exactly which jets to install in specific locations within their hot tub or home spa. The benefits of different jet types have grown substantially with the development of independent seating control. In older spas and hot tubs, one set of controls ran all of the therapy jets, but independent seating control allows each bather to control the strength and intensity of therapy in their own individual seat.

Spas and hot tubs have been around in one form or another for centuries, but only in the last few decades have technology, materials and manufacturing improved to the point where a home spa is affordable enough and reliable enough to be within reach of most people. Although the field of spas and hot tubs has enjoyed considerable innovation throughout much of the last decade, much of the improvements have been directed toward improving the hydrotherapy systems, the jets, and the construction materials, particularly the construction materials relating to the tubs, with little effort directed toward improving their overall usefulness. As a result, the art suffers in that spas and hot tubs are not versatile in terms of providing users with the ability to not only enjoy the benefits of hot water, but also the benefits of chilled water.

Accordingly, it is an object of the invention to provide a spa system incorporating a tub and heating and cooling devices operatively associated with a circulating system for providing the ability to provide the tub with hot water and also with cold water.

It is another purpose of the invention to provide new and improved spa system that is easy to construct.

It is still another purpose of the invention to provide new and improved spa system that is inexpensive.

It is yet another purpose of the invention to provide a spa system that is easy to use, and that incorporates a tub held by a chassis that is specifically adapted to accommodate a water cooling device to be operatively plumbed with a circulating system for the tub that is concurrently operatively plumbed to a water heating device.

It is a further provision of the invention to increase the usefulness of spa systems.

SUMMARY OF THE INVENTION

According to the principle of the invention, a spa system is provided which is low in cost, which is simple in structure, which is safe, which incorporates a single tub, and which incorporates a circulating system adapted to withdraw and return water relative to the tub together with heating and cooling devices operatively coupled in series to the circulating system for chilling and heating the water circulating therethrough from the tub.

According to the invention, there is provided a spa system including a tub, water heating and cooling devices operatively coupled in series to a circulating system adapted to withdraw and return water relative to the tub, and a thermostat operatively coupled to the heating and cooling devices, in accordance with the principle of the invention. A chassis supports the tub, and there is a cooling device receiving area formed in the chassis, in which the cooling device is disposed at the cooling device receiving area. Opposed first and second rails are carried by the chassis, and are disposed on either side of the cooling device receiving area. A platform has opposed first and second sides received against the first and second rails, respectively, thereby supporting the platform at the cooling device receiving area. The cooling device is supported atop the platform. An access opening is formed through the chassis and leads to the cooling device receiving area. A closure is provided, which is adapted to be secured to the chassis for enclosing the access opening.

According to the invention, there is provided a tub supported by a chassis, a substantially enclosed space formed between the tub and the chassis, and first and second vents through the chassis leading to the enclosed space. Water heating and cooling devices are operatively coupled in series to a circulating system adapted to withdraw and return water relative to the tub, and a thermostat is operatively coupled to the heating and cooling devices. The cooling device incorporates a fan operative for drawing air into the enclosed space through the first vent in response to activation of the cooling device to cool the cooling device. The spa system incorporates a blower, which is operative for expelling air from the enclosed space through the second vent currently with the operation of the fan of the cooling device. A cooling device receiving area is formed in the enclosed space, and the cooling device is disposed at the cooling device receiving area. Opposed first and second rails are carried by the chassis, and are disposed on either side of the cooling device receiving area. A platform has opposed first and second sides received against the first and second rails, respectively, thereby supporting the platform at the cooling device receiving area. The cooling device is supported atop the platform. An access opening is formed through the chassis and leads to the cooling device receiving area. A closure is provided, which is adapted to be secured to the chassis for enclosing the access opening forming part of the chassis. In a preferred embodiment, the first vent is formed in the closure.

According to the invention, there is provided a spa system including a tub supported by a chassis, a substantially enclosed space formed between the tub and the chassis, and first and second vents through the chassis leading to the enclosed space. Water heating and cooling devices are operatively coupled in series to a circulating system adapted to withdraw and return water relative to the tub. According to the invention, the cooling device is operatively coupled to a blower, and a thermostat is operatively coupled to the heating and cooling devices. The cooling device incorporates a fan operative for drawing air into the enclosed space through the first vent in response to activation of the cooling device to cool the cooling device. The blower is activated by the cooling device in response to the activation thereof for expelling air from the enclosed space through the second vent. A cooling device receiving area is formed in the enclosed space, and the cooling device is disposed at the cooling device receiving area. Opposed first and second rails are carried by the chassis, and are disposed on either side of the cooling device receiving area. A platform has opposed first and second sides received against the first and second rails, respectively, thereby supporting the platform at the cooling device receiving area. The cooling device is supported atop the platform. An access opening is formed through the chassis and leads to the cooling device receiving area. A closure is provided, which is adapted to be secured to the chassis for enclosing the access opening forming part of the chassis. In a preferred embodiment, the first vent is formed in the closure.

In a spa system including a tub supported by a chassis, a substantially enclosed space formed between the tub and the chassis, and a water heater operatively coupled to a circulating system adapted to withdraw and return water relative to the tub, improvements therein according to the principle of the invention including a water cooling device operatively coupled to the circulating system in series with the water heater, and a thermostat operatively coupled to the heating and cooling devices. The improvements according to the present embodiment further include first and second vents through the chassis leading to the enclosed space, the cooling device incorporating a fan operative for drawing air into the enclosed space through the first vent in response to activation of the cooling device, and a blower operative for expelling air from the enclosed space through the second vent currently with the operation of the fan of the cooling device. A cooling device receiving area is formed in the enclosed space, and the cooling device is disposed at the cooling device receiving area. Still further the improvements incorporate opposed first and second rails, carried by the chassis, disposed on either side of the cooling device receiving area, and a platform having opposed first and second sides received against the first and second rails, respectively, thereby supporting the platform at the cooling device receiving area, wherein the cooling device is supported atop the platform. The improvements also include an access opening through the chassis leading to the cooling device receiving area, and a closure adapted to be removably secured to the chassis for enclosing the access opening forming part of the chassis, in which the first vent is formed in the closure.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION OF A PREFERRED EMBODIMENT

Figure 1:
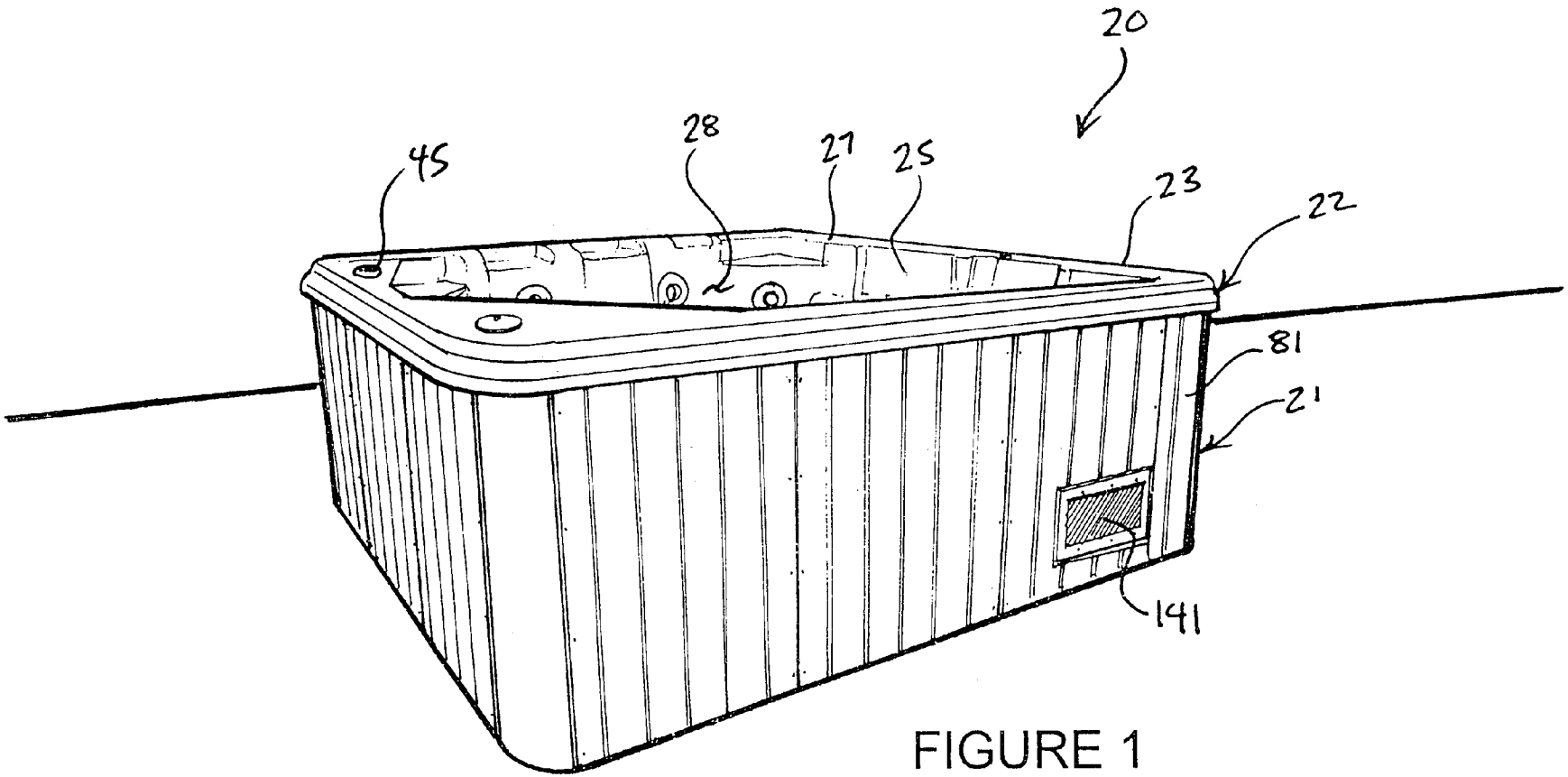
FIG. 1 is perspective view of a spa system constructed and arranged in accordance with the principle of the invention.
Figure 4:
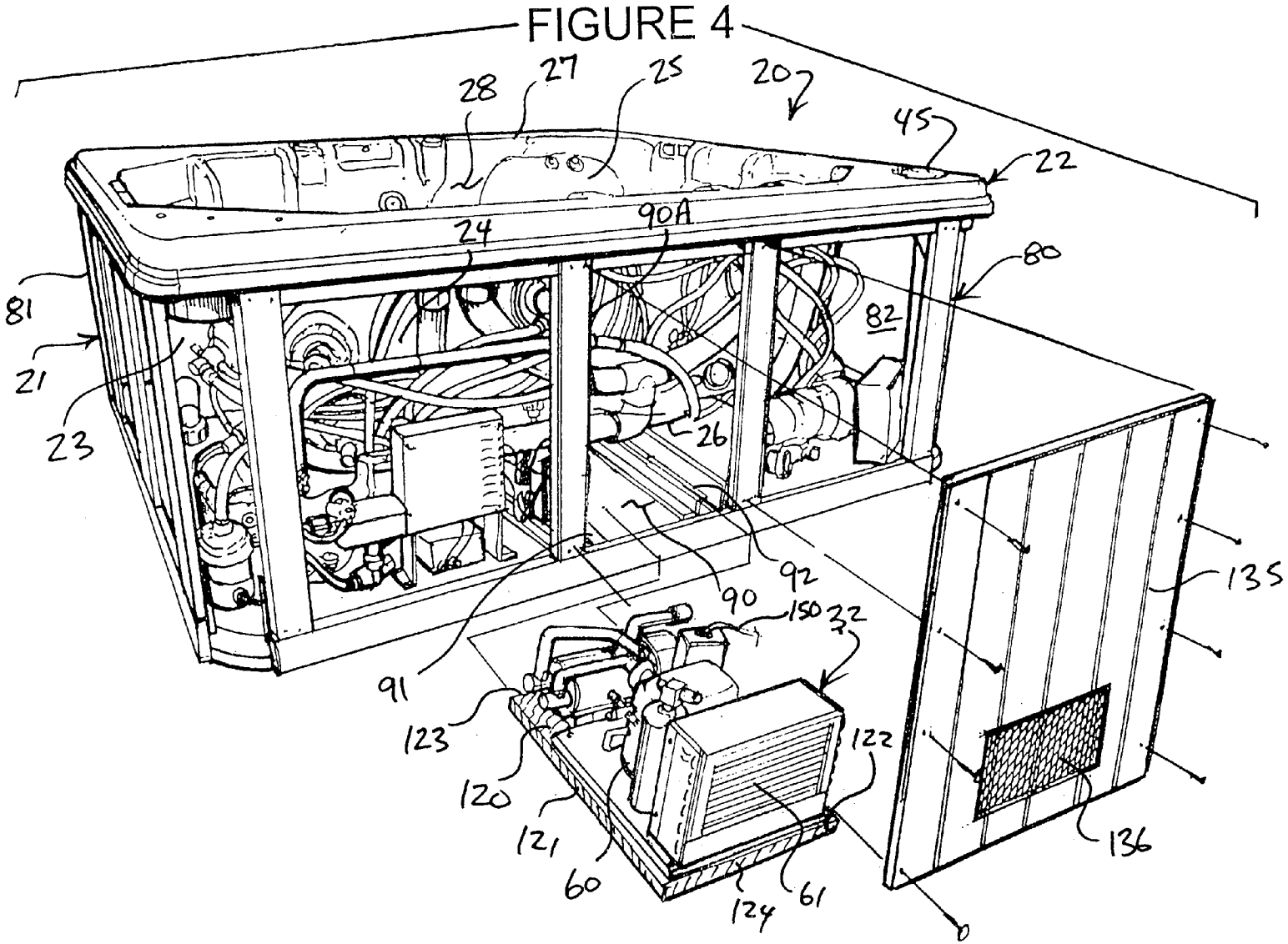
FIG. 4 is a partially exploded perspective view of the spa system of FIG. 1 illustrating a chiller disposed adjacent to a chiller receiving area formed in a chassis supporting a tub.

Referring now to the drawings, in which like reference characters indicate corresponding elements throughout the several views, attention is first directed to FIG. 1 in which there is seen a spa system 20 including a chassis 21 supporting a tub 22 for holding a volume of water. Referring to FIG. 4, tub 22 includes an upstanding continuous sidewall 23 having an outer surface 24, an inner surface 25, a closed bottom 26, and an open top 27 leading into a chamber 28 for holding a volume of water. Chamber 28 is bound and defined by inner surface 25, and closed bottom 26 opposing open top 27.

Tub 22 is generally square in shape. However, tub 22 may be of any suitable or desired configuration, such as round, rectangular, kidney, or other selected shape, and is preferably an integral tub structure. Tub 22 is constructed of any suitable material or combination of materials generally used in swimming pool and hot tub construction, such as fiberglass, acrylic, concrete, or other combinations of artificial and/or synthetic materials. It has been found convenient for the tub 12 to have a size approximately equivalent to a circle having a 6 to 12 foot diameter, in which chamber 28 has a capacity of approximately 400 to 2000 gallons. A spa system constructed and arranged in accordance with the principle of the invention may be configured with any desired volume capacity. Furthermore, although not specifically shown tub 22 may be formed with one or more seats for providing one or more seating areas within chamber 28, and also one or more lounge seats for providing one or more lounging areas within chamber 28. Any suitable configuration of spa tub may be used with spa system 20 without departing from the invention.

Spa system 20 may include a hydrotherapy system incorporating specialized hydrotherapy pumps associated with a hydrotherapy circulating system adapted to withdraw water from chamber 28 and return it to chamber 28 through a variety of jets thereby introducing jets of water into the volume of water disposed in chamber 28. According to conventional practice, those having regard for the art will readily appreciate that spa system 20 can be customized with any variety and arrangement of jets that range from multi-purpose jets to highly specialized jets.

Figure 3:
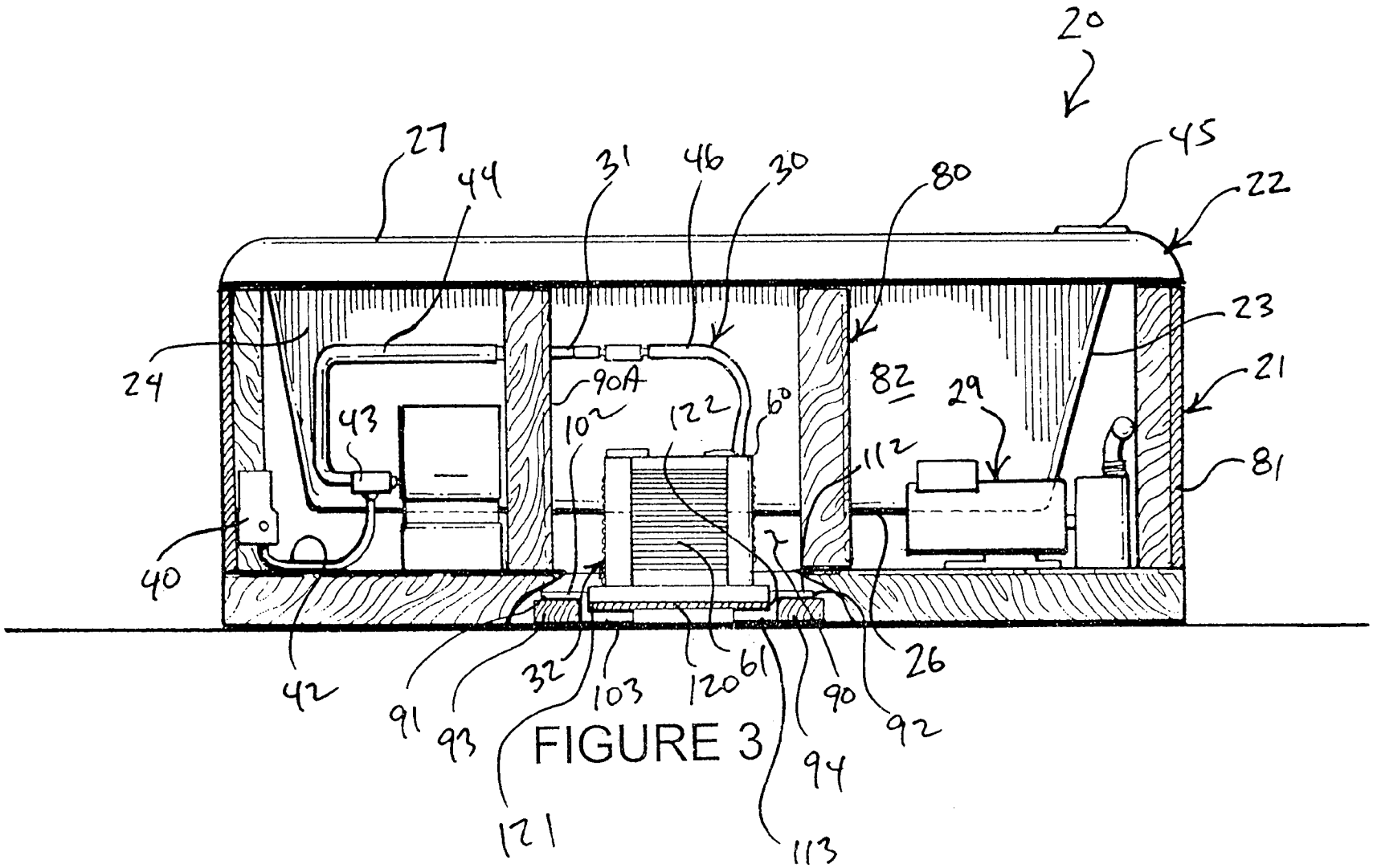
FIG. 3 is a simplified, partially schematic side elevational view of the spa system of FIG. 1.

As a matter of example, FIG. 3 illustrates a conventional hydrotherapy system generally indicated by the reference character 29, which is coupled to tub 22 chamber 28 in fluid communication with a series of conduits (not shown). When activated, hydrotherapy system 29 withdraws water from tub 22 chamber 28 and then returns the water back into tub 22 chamber 28 through a series of jets at tub 22, which eject water into the water in tub 22 chamber 28 in the form of jets of water. The jets of water agitate the water held by tub 22 chamber 28 thereby ensuring a relatively even temperature of the water throughout tub 22 chamber 28, and provide a water massaging affect to users in the water held by tub 22 chamber 28, which promotes muscle relaxation. The series of conduits coupling hydrotherapy system 29 to tub 22 chamber 28 forming a part thereof will normally include an outflow conduit through which water is drawn from tub 22 chamber 28 and a network of outflow conduits for receiving water from the inflow conduit and directing the water to the jets at tub 22. Hydrotherapy system 29 is conventional and well-known to those having regard for the art, further details of which will readily occur to the skilled artisan and need not be described in further detail. Although desirable, hydrotherapy system 29 can be omitted, if desired.

Figure 2:
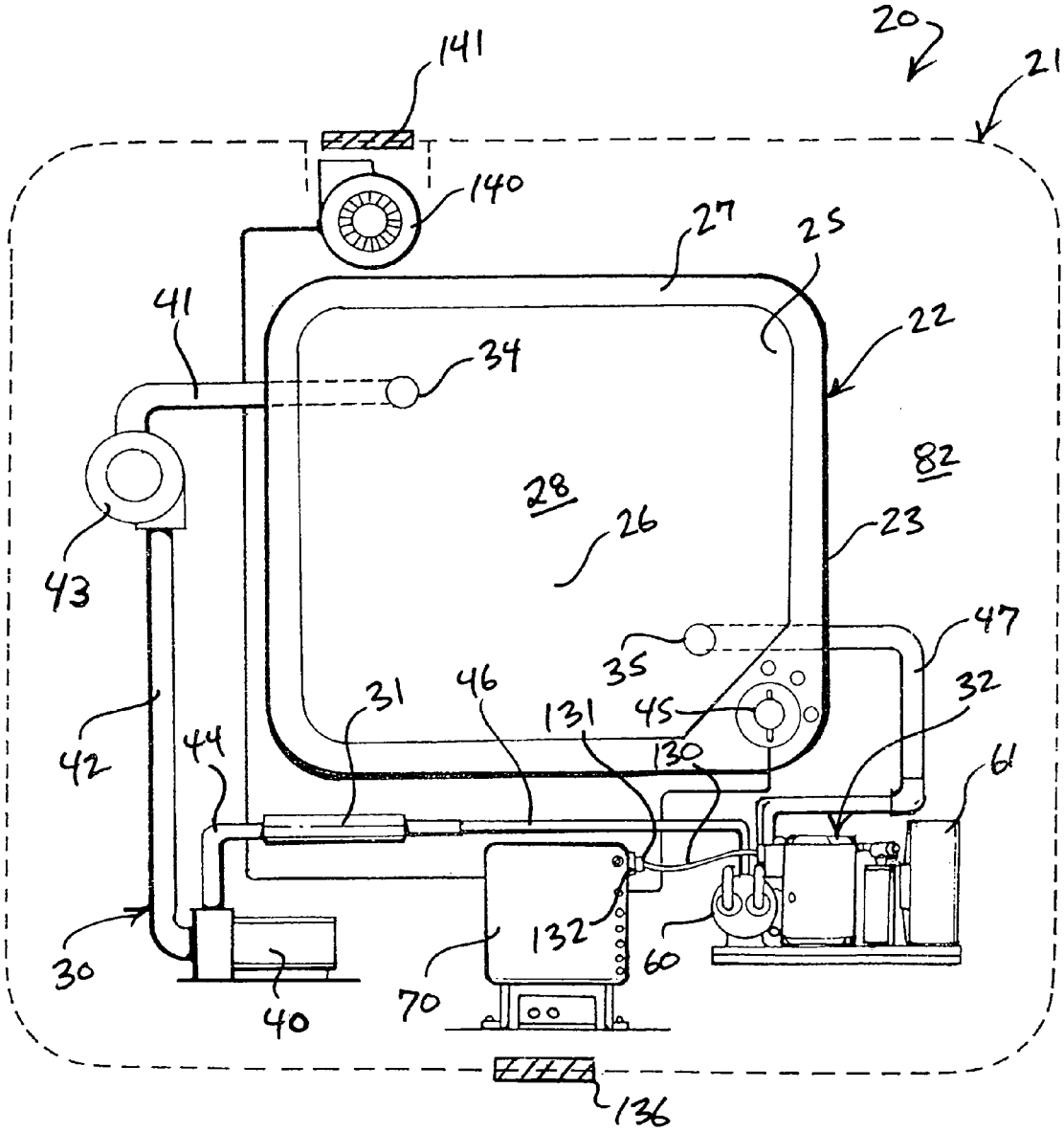
FIG. 2 is a schematic plan view of the spa system of FIG. 1.

Referring to FIG. 2, tub 22 chamber 28 is associated with a water circulating system 30 that, when operational, withdraws and returns water relative to tub 22 chamber 28. According to the principle of the invention, water heating and cooling devices 31 and 32 are operatively coupled in series to circulating system 30. Circulating system 30 withdraws water from chamber 28 through a drain port 34 formed in tub 22 at a predetermined flow rate, filters the water for particulate matter, and conducts the water first through heating device 31 and then through cooling device 32 before returning the water to tub 22 chamber 28 through an inlet port 35. In this embodiment, drain port 34 is formed in closed bottom 26, and it can be formed elsewhere, if desired. Circulating system 30 couples water heating and cooling devices 31 and 32 in fluid communication with the water held by tub 22 chamber 28. According to the principle of the invention, water heating and cooling devices 31 and 32 are operatively coupled/plumbed in series to circulating system 30 thereby allowing heating device 31, when activated, to heat the water passing therethrough, and allowing cooling device 32, when activated, to chill the water passing therethrough. With respect to heating device 31, the term "operatively coupled" describing its coupling to circulating system 30 means that heating device 31 functions to heat the water passing through circulating system 30 when heating device 31 is activated. With respect to cooling device 32, the term "operatively coupled" describing its coupling to circulating system 30 means that cooling device 32 functions to chill/cool the water passing through circulating system 30 when cooling device 32 is activated.

In this preferred embodiment, circulating system 30 includes a water pump 40 for withdrawing water from tub 22 chamber 28 through drain port 34 into a conduit 41 and to the inlet port of a conventional large capacity filter unit 43 that filters out sediment and particulate matter from the water stream. The filtered water is applied through the outlet port of filter unit 43 through a conduit 42 to pump 40, which in turn discharges the water under pressure through a conduit 44 to heating device 31, which is a conventional spa or swimming pool water heater well-known to those having regard for the art, further details of which will readily occur to the skilled artisan. Heating device 31 is operated by electricity from a power source (not shown), such as a dedicated power source, a battery power source, a generator, etc., and is operatively coupled to a thermostat 45, and when operational functions to heat the water passing through circulating system 30 for ultimately heating the water held by tub 22 chamber 28 to a predetermined temperature. The selection of heating device 31 is based on the desire to heat the water in tub 22 chamber 28 up to a nominal 106 degrees Fahrenheit.

Figure 7:
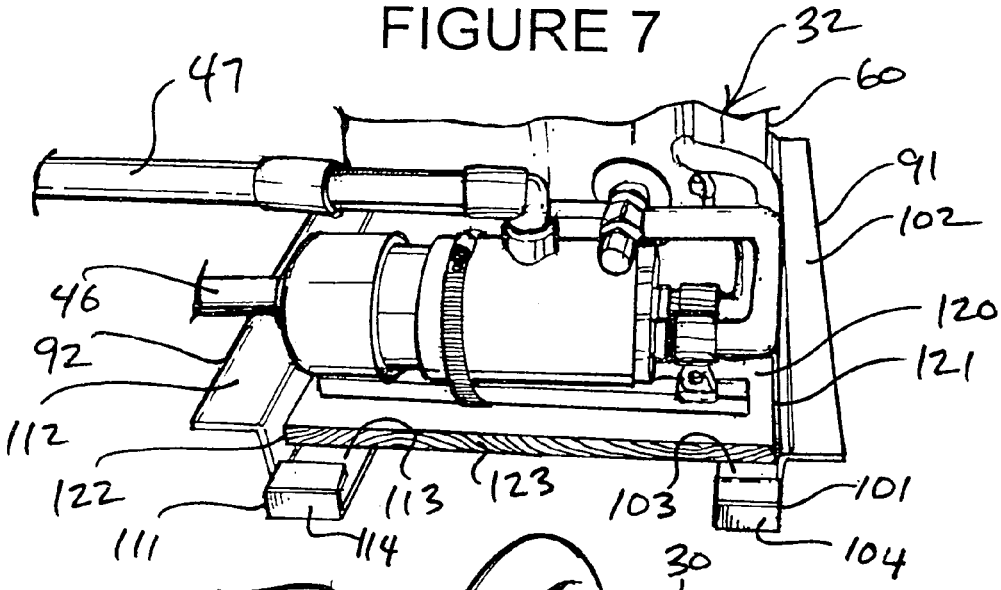
FIG. 7 is a fragmented perspective view of the chiller of FIG. 4 shown coupled in fluid communication to inflow and outflow conduits.
Figure 8:
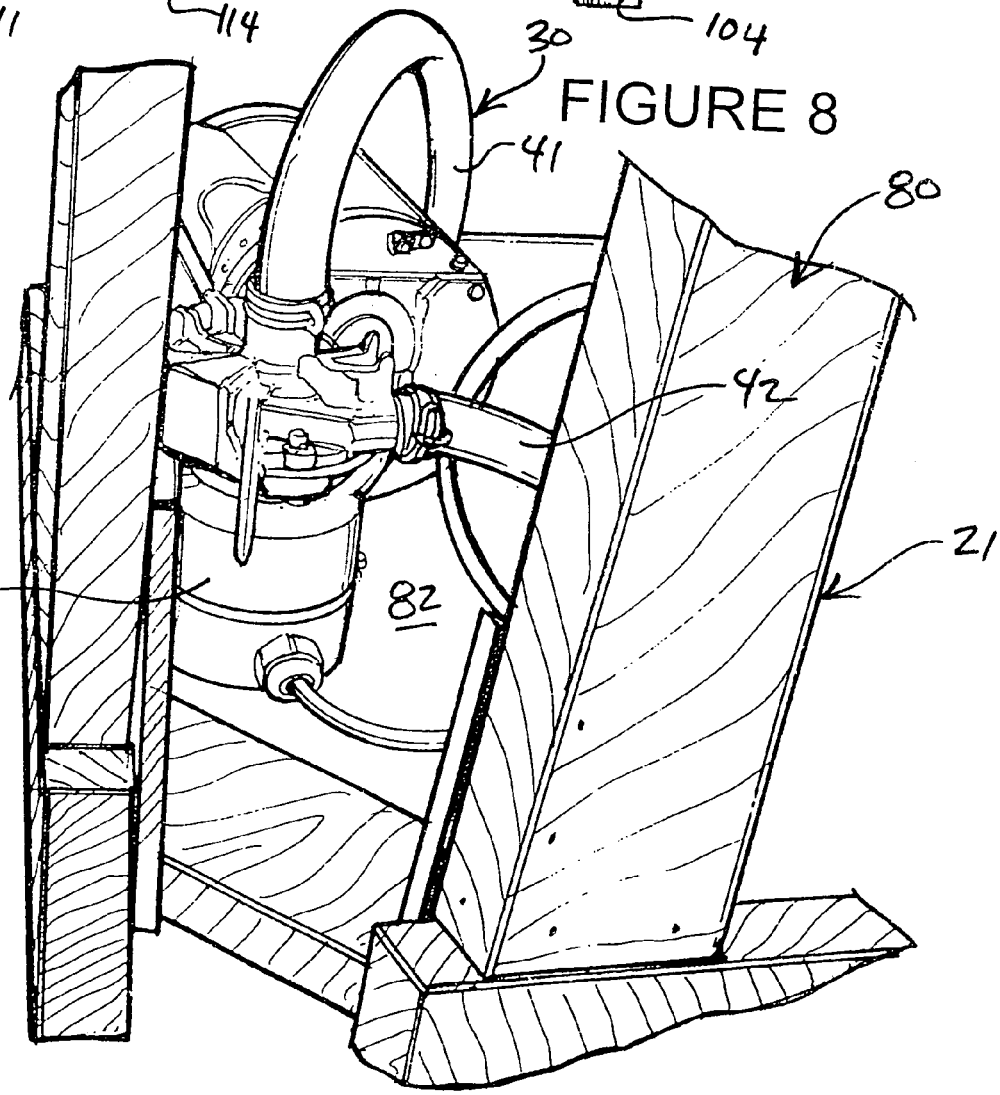
FIG. 8 is a fragmented perspective view of a fluid pump of the spa system of FIG. 1.
Figure 9:
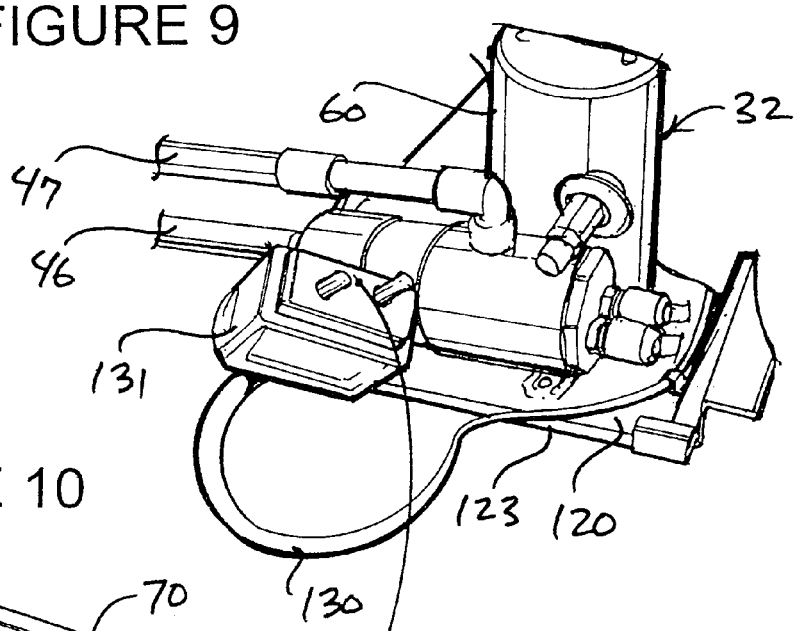
FIG. 9 is a fragmented perspective view of the chiller of FIG. 4 showing a plugged electrical interconnection adapted to be coupled to a controller of the spa system of FIG. 1.

From heating device 31 the water is then applied through the outlet port of heating device 31 through a conduit 46 to an inlet port of cooling device 32. Cooling device 32 is operated by electricity from a power source (not shown), such as a dedicated power source, a battery power source, a generator, etc., and is operatively coupled to thermostat 45, and when operational functions to cool/chill the water passing through circulating system 30 for ultimately cooling/chilling the water held by tub 22 chamber 28 to a predetermined temperature. From cooling device 32 the water is then applied through the outlet port of cooling device 32 through a conduit 47 to inlet port 35, which conducts the water back into tub 22 chamber 28. As a matter of illustration, FIGS. 7 and 9 illustrates conduit 46 plumbed to the inlet port of cooling device 32, and conduit 47 plumbed to the outlet port of cooling device 32.

Pump 40 is a conventional spa or swimming pool water circulating pump on the order of a 0.05 to 2 horsepower unit that delivers the water at a flow rate of approximately 3 to 120 gallons per minute. Filter unit 43 is a conventional and well-known spa filter unit, which is sized to accommodate the maximum flow rate of pump 40.

Figure 6:
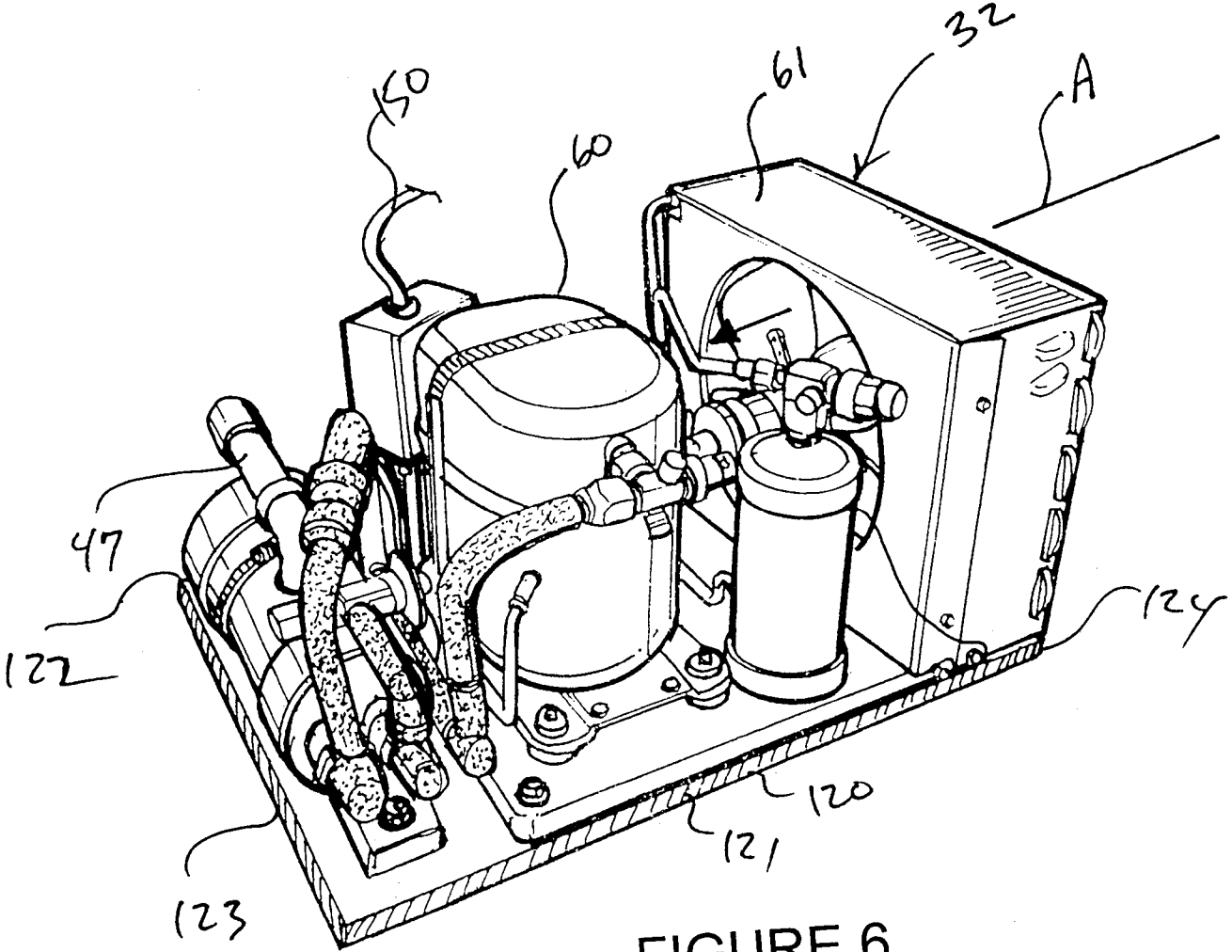
FIGURE 6 PRIOR ART
FIG. 6 is a perspective view of the chiller of FIG. 4.

With momentary attention directed to FIG. 6, in the preferred embodiment herein disclosed cooling device 32 is a conventional inline water chiller, designated generally at 60, provided under the exemplary trademark DELTA STAR, the specific details of which will not be discussed as they are known in the art. Chiller 60 incorporates a fan 61, which activates concurrently with the activation of chiller 60 blowing cooling air over chiller 60 in the direction indicated by the arrowed line A thereby keeping chiller 60 cool during its operation and preventing it from overheating, which may cause it to operate inefficiently or fail. Although the chiller provided under the trademark DELTA STAR is preferred, other forms of chillers can be used.

The selection of cooling device 32, such as chiller 60, is based on the desire to chill the water in tub 22 chamber 28 to a nominal 62 degrees Fahrenheit, plus or minus 10 degrees Fahrenheit. And so chiller 60 is sufficiently powerful to adjust the temperature of the water flowing through circulating system 30 to the desired chilled temperature. Consistent with the teachings of the invention, any suitable chiller, refrigeration unit, or like device capable of removing heat from water in order to chill or cool it according to the teachings set forth herein can be used without departing from the invention. Chiller 60 is light in weight and not bulky, and is easy to install and incorporate with circulating system 30 allowing spa system 20 to be prefabricated at a manufacturing site and easily transported for installation at specified site. An example of another suitable chiller that may be use with the invention include the chiller offered by Schreiber Engineering Corp. under the trademark TRUETON.

Referring back to FIG. 2, thermostat 45 is operatively coupled to water heating device 31 and to water cooling device 32, which was mentioned previously in this specification. Thermostat 45 is mounted to tub 22 at the top edge thereof forming part of open top 27 of tub 22, which allows it to be easily accessed from within tub 22 chamber 28. Thermostat 45 can be mounted elsewhere, if desired. Thermostat 45 is used in conjunction with heating device 31 and cooling device 32 to take water held in tub 22 chamber 28 to a predetermined temperature, and to maintain the water in tub 22 chamber 28 at the predetermined temperature. Thermostat 45 is operatively coupled to heating and cooling devices 31 and 32 with a controller 70, which is coupled to thermostat 45 and to heating and cooling devices 31 and 32 with conventional electrical interconnections. All of the components of spa system 20, including pump 40, heating device 31, cooling device 32, thermostat 45, and also hydrotherapy system 29, plug into controller 70 providing easy installation with no confusing wiring, or miss-wiring.

The temperature of the water in tub 22 chamber 28 is managed by circulating system 30, heating and cooling devices 31 and 32, thermostat 45 and controller 70, in accordance with the principle of the invention. In operation, thermostat 45 functions to sense the temperature of water held in tub 22 chamber 28, which is monitored or otherwise "seen" by controller 70. Thermostat 45 is used to set the water in tub 22 chamber 28 to a predetermined temperature from a starting temperature. If the predetermined temperature set by thermostat 45 is greater than the starting temperature of the water in tub 22 chamber 28, controller 70 is responsive and concurrently activates pump 40 and heating device 31 thereby heating the water as it is circulated through circulating system 30 relative to tub 22 chamber 28. Pump 40 and heating device 31 operate concurrently until the temperature of the water in tub 22 chamber 28 as sensed by thermostat 45 reaches the predetermined heated temperature, at which point controller 70 is responsive and concurrently deactivates pump 40 and heating device 31. The thermostat 45 being set at the predetermined heated temperature, controller 70 will continue to periodically activate pump 40 and heating device 31 as needed in order to maintain the temperature of the water in tub 22 chamber 28 at or near the predetermined heated temperature set by thermostat 45. Preferably, controller 70 is configured to activate pump 40 and heating device 31 when the temperature of the water in tub 22 chamber 28 as sensed by thermostat 45 falls approximately 2-4 degrees Fahrenheit below the predetermined heated temperature set by thermostat 45. The operation of heating device 31 to heat and maintain the water in tub 22 chamber 28 to a predetermined heated temperature constitutes a heating mode of operation of spa system 20. If desired, pump 40 can be configured to operate constantly to provide continuous water circulation through circulating system 30, in which the operation of the remaining components of circulating system 30 remains the same as herein specifically described.

If the predetermined temperature set by thermostat 45 is lesser than the starting temperature of the water in tub 22 chamber 28, controller 70 is responsive and concurrently activates pump 40 and cooling device 32 thereby cooling the water as it is circulated through circulating system 30 relative to tub 22 chamber 28. Pump 40 and cooling device 32 operate concurrently until the temperature of the water in tub 22 chamber 28 as sensed by thermostat 45 reaches the predetermined chilled temperature, at which point controller 70 is responsive and deactivates pump 40 and cooling device 32. The thermostat 45 being set at the predetermined chilled temperature, controller 70 will continue to periodically activate pump 40 and cooling device 32 as needed in order to maintain the temperature of the water in tub 22 chamber 28 at or near the predetermined chilled temperature set by thermostat 45. Preferably, controller 70 is configured to activate pump 40 and cooling device 32 when the temperature of the water in tub 22 chamber 28 as sensed by thermostat 45 rises approximately 2-4 degrees Fahrenheit above the predetermined chilled temperature set by thermostat 45. The operation of cooling device 32 to cool and maintain the water in tub 22 chamber 28 to a predetermined chilled temperature constitutes a chilling mode of operation of spa system 20.

Accordingly, by using thermostat 45 the temperature of the water in tub 22 chamber 28 can be increased for providing hot water in tub 22 chamber 28, and can be decreased for providing cold water in tub 22 chamber 28. This provision allows users to, for instance, enjoy a hot water spa during the cold months of the year, and a cold water spa during the hot months of the year, all conveniently and efficiently in a single tub 22 chamber 28 utilizing heating and cooling devices 31 and 32 operatively coupled in series to circulating system 30. It is to be understood that controller 70 activates heating device 31 and pump 40 to heat the water from tub 22 chamber 28 passing through circulating system 30 in order to bring the temperature of the water in tub 22 chamber 28 up to a desired temperature as set by thermostat 45. Similarly, controller 70 activates cooling device 32 to chill or cool the water from tub 22 chamber 28 passing through circulating system 30 in order to bring the temperature of the water in tub 22 chamber 28 down to a desired temperature as set by thermostat 45. And so the selective activation of heating device 31 and cooling device 32 is made by controller 70 in response to the temperature set by thermostat 45, in which the selective activation of heating device 31 and cooling device 32 is dependent on the temperature of the water and the selected desired temperature which is set at thermostat 45.

In sum, circulating system 30 is adapted to withdraw and return water relative to tub 22 chamber 28, in which water heating and cooling devices 31 and 32 are operatively coupled to thermostat whereby the temperature of the water in tub 22 chamber 28 is set and maintained by the selective operation of heating and cooling devices 31 and 32 in response to operation of thermostat 45. According to the principle of the invention, the water in tub 22 chamber 28 can be heated to a desired hot temperature for providing heated spa water, and can be cooled to a desired chilled temperature for providing chilled spa water, all in a single tub 22 chamber 28 and by using a single circulating system 30 incorporating heating and cooling devices 31 and 32 operatively coupled thereto in series.

Referring to FIGS. 3 and 4, chassis 21 will now be discussed. Other than the improvements made to chassis 21 to accommodate cooling device 31, chassis 21 is generally conventional in nature in that it supports tub 22 and encloses circulating system 30 including heating device 31 and cooling device 32 and the other workings and devices of spa system 20 not herein specifically addressed, such as speakers and sound systems, switches, water conduits, etc. Chassis 21 generally consists of a frame 80, which is fashioned conventionally of wood and/or steel framing members, and decorative siding 81, which is applied exteriorly to frame 80 for concealing frame 80 and thereby forming a substantially enclosed space 82 between outer surface 24 of tub 22 and chassis 21, and for providing a desired decorative appearance. This arrangement of chassis 21 consisting of frame 80 and siding 81 is conventional and notoriously well-known to those having ordinary skill in the art, further details of which will not be discussed as they will readily occur to the skilled artisan. Circulating system 30, heating and cooling devices 31 and 32, controller 70, pump 40, hydrotherapy system 29, and the various conduits and workings of spa system 20 are maintained in space 82 and preferably secured to chassis 21 in a conventional manner, such as with nut-and-bolt assemblies, mounting brackets, fixtures, etc.

According to the invention, chassis 21 is unique in structure in that it is specifically adapted and arranged to accommodate cooling device 32 permitting it, when desired, to operatively coupled to circulating system 30 in series with heating device 31. The provision of operatively coupling water heating and cooling devices 31 and 32 to circulation system 30 allows heating and cooling devices 31 and 32 to quickly and efficiently heat and chill the water passing therethrough as needed, and eliminates the need for a separate circulation system for heating and chilling. Operatively coupling heating and cooling devices 31 and 32 to circulating system 30 produces a quite surprising result in that the temperature of the water in tub 22 chamber 28 can be very easily and efficiently controlled and managed.

Figure 5:
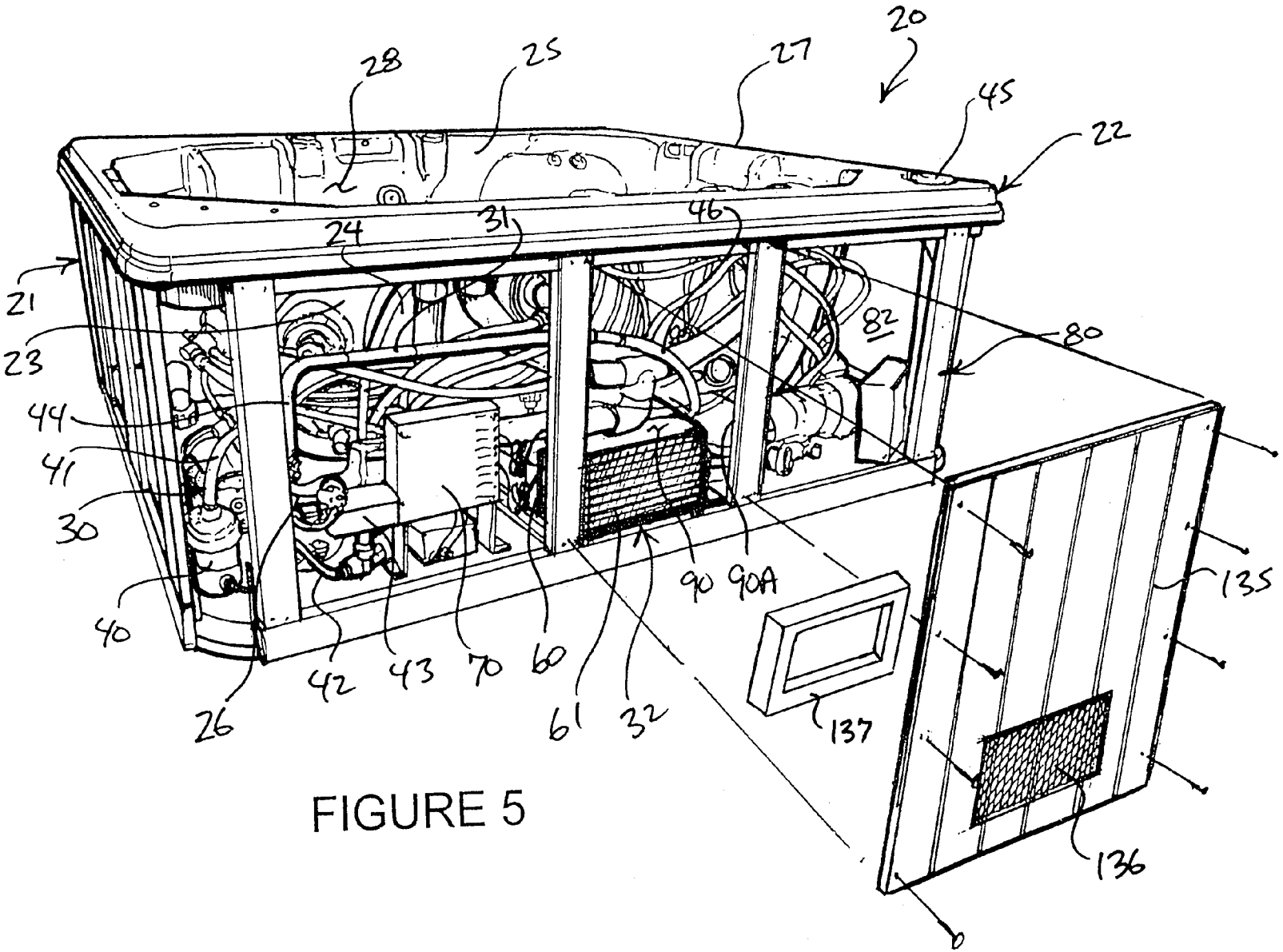
FIG. 5 is a view very similar to the view of FIG. 4 showing the chiller positioned in the chiller receiving area, and a chiller cover detached from the chassis.

FIGS. 3, 4, 5, 11, and 12, illustrate a cooling device receiving area 90 formed by frame 80 of chassis 21 in enclosed space 82, which represents an improvement to chassis 21 according to the principle of the invention. Frame 80 also bounds an access opening 90A leading to receiving area 90. Cooling device 32 is situated in receiving area 90 through access opening 90A as shown in FIGS. 3 and 5, and plumbed to circulating system 30 as previously described utilizing conventional spa plumbing techniques. Circulating system 30 passes into and through receiving area 90, in accordance with the principle of the invention, so that cooling device 32 can be plumbed to circulating system 30 when cooling device 32 is positioned at receiving area 90.

Figure 12:
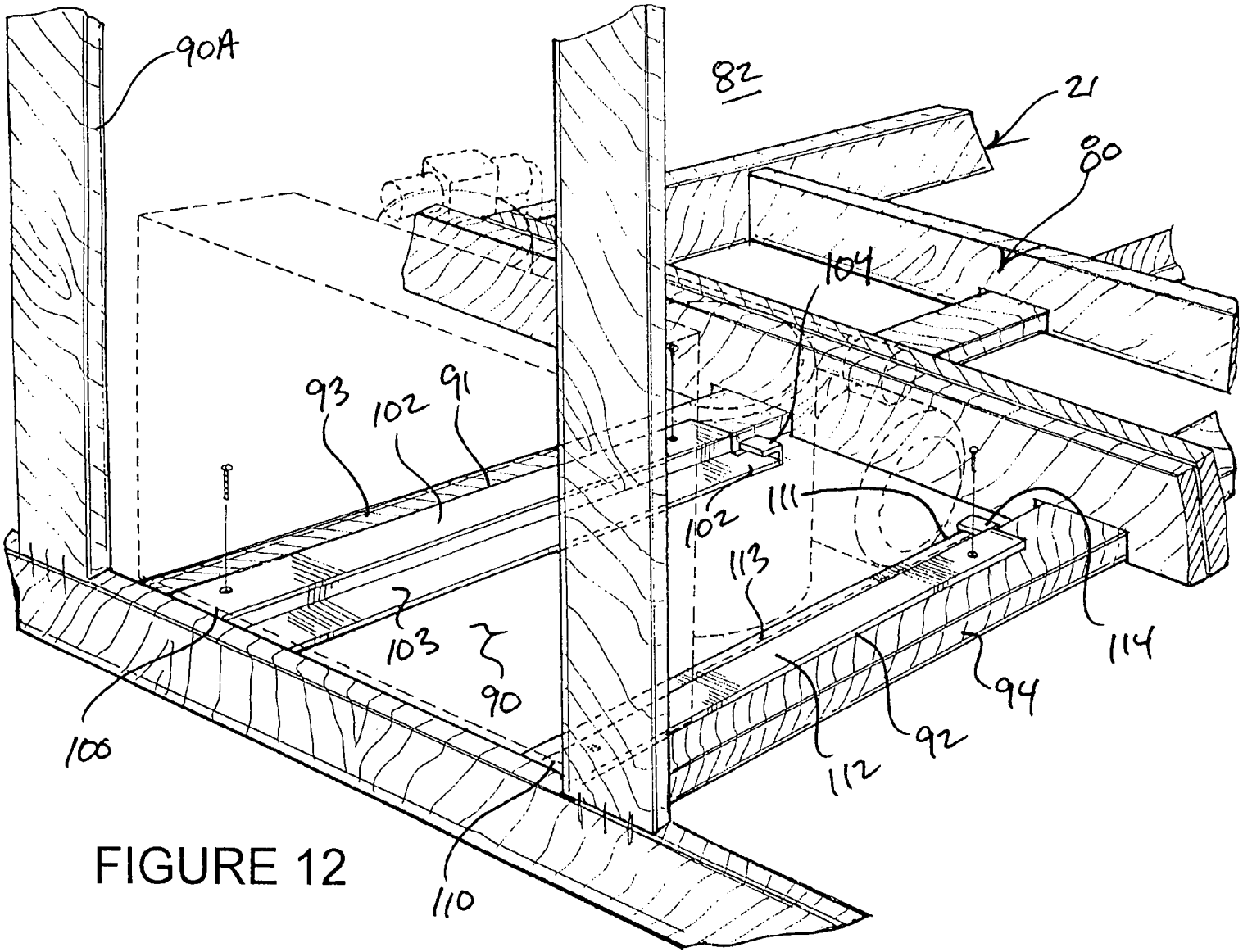
FIG. 12 is an enlarged fragmented perspective view of the chassis of FIG. 11 illustrating opposed rails forming part of a chiller receiving area of the spa system of FIG. 1.
Figure 13:
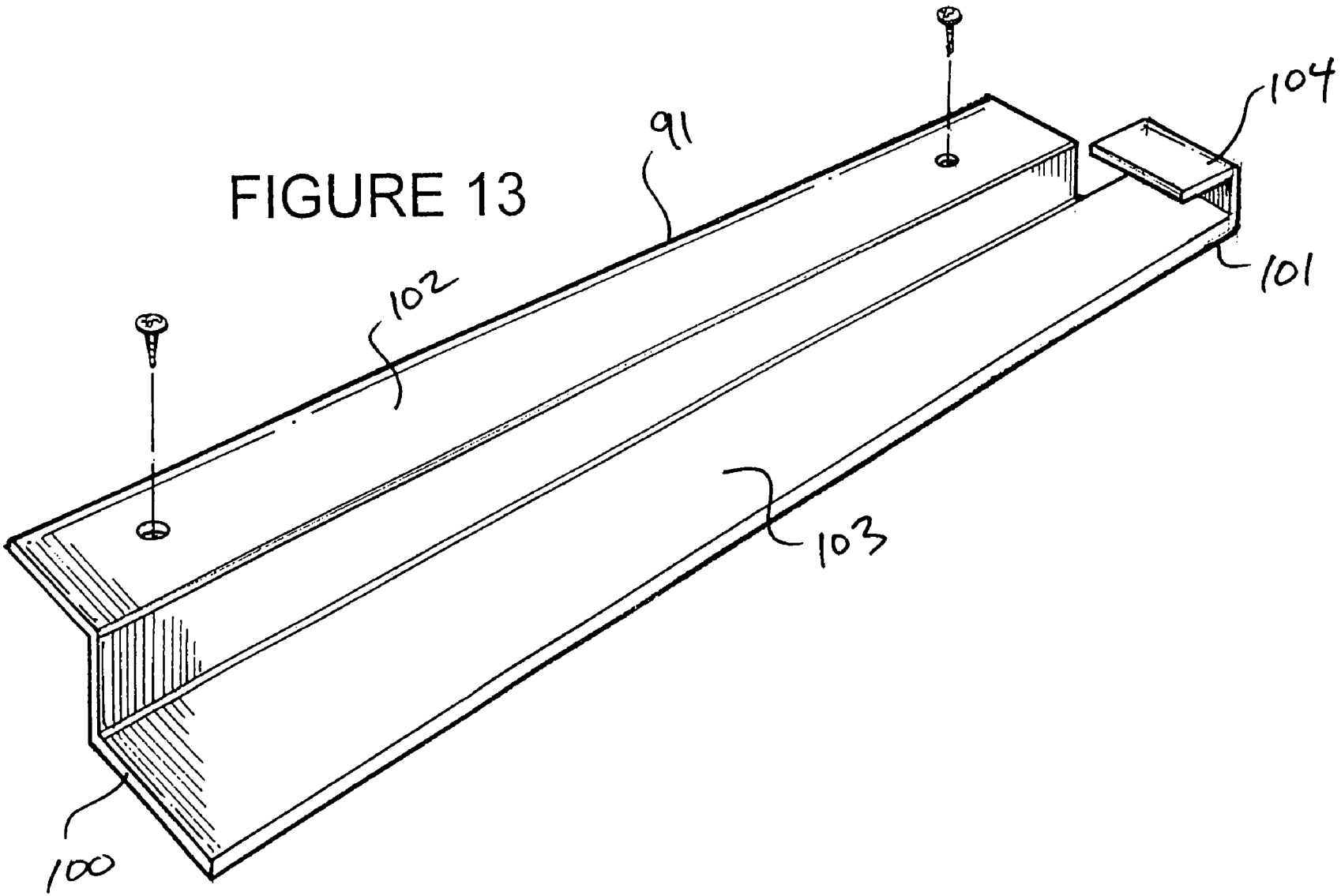
FIG. 13 is a perspective view of one of the rails of FIG. 12.

According to the principle of the invention, and with specific reference to FIG. 12, opposed rails 91 and 92 are carried by frame 80 of chassis 21, and are disposed on either side of receiving area 90. Rails 91 and 92 are spaced apart and substantially parallel relative to one another, and are fastened, such as with nails, screws, adhesive, or other suitable fasteners or combination of fasteners, to opposed parallel support members 93 and 94 forming part of frame 80. Referring also to FIG. 13, rail 91 is fashioned of steel, aluminum, or other strong and substantially rigid material or combination of materials, is elongate, and includes opposed inner and outer ends 100 and 101, an attachment plate 102 positioned atop, and secured to, support member 93, a support plate 103 extending into receiving area 90, and an abutment 104 formed at outer end 101. Rail 92 is the mirror image of rail 91, and like rail 91 is fashioned of steel, aluminum, or other strong and substantially rigid material or combination of materials, is elongate, and includes opposed inner and outer ends 110 and 111, an attachment plate 112 positioned atop, and secured to, support member 94, a support plate 113 extending into receiving area 90, and an abutment 114 formed at outer end 111.

Looking to FIGS. 4 and 6, cooling device 32 is supported by platform 120. Cooling device 32 is situated atop platform 120, which has opposing sides 121 and 122 and opposed inner and outer ends 123 and 124, and is secured thereto with fasteners, such as screws, nut-and-bolt assemblies, rivets, etc. Fan 61 is situated at outer end 124 of platform 120, and the inlet and outlet ports of cooling device 32 to which conduits 46 and 47 are plumbed are situated at inner end 123 of platform 120.

To install cooling device 32, it is taken up together with platform 120 and positioned into receiving area 90 through access opening 90A inner end 123 of platform 120 first, in which inner end 123 of platform 120 is directed inwardly into space 82. Platform 120 is positioned atop support plates 103 and 113 of rails 91 and 92 as best seen in FIG. 3, in which sides 121 and 122 are received atop and against support plates 103 and 113 of rails 91 and 92, respectively. FIG. 7 shows platform 120 situated onto rails 91 and 92, in which side 121 is received atop and against support plate 103 of rail 91, and side 122 is received atop and against support plate 113 of rail 92. Platform 120 forced inwardly along rails 91 and 92 until its inner end 123 at sides 121 and 122 is received against abutments 104 and 114, respectively. The length of platform 120 from inner end 123 to outer end 124 is substantially coextensive to the length of rails 91 and 92 from their inner ends to their outer ends. Abutments 104 and 114 together limit the inwardly movement of platform 120 into receiving area 90. Properly positioned onto and supported by rails 91 and 92, sides 121 and 122 rest entirely on support plates 103 and 113, respectively, and inner end 123 is received against abutments 104 and 114. With cooling device 32 situated atop and secured to platform 120 and platform 120 situated onto rails 91 and 92 as herein described, cooling device 32 situated atop platform 120 is thereby suitably disposed in receiving area, in accordance with the principle of the invention. At this point, the inlet and outlet ends of cooling device 32 may be plumbed to conduits 46 and 47, respectively. FIG. 12 shows cooling device 32 in phantom outline as it would appear situated in receiving area 90 with platform 120 situated against rails 91 and 92.

Figure 10:
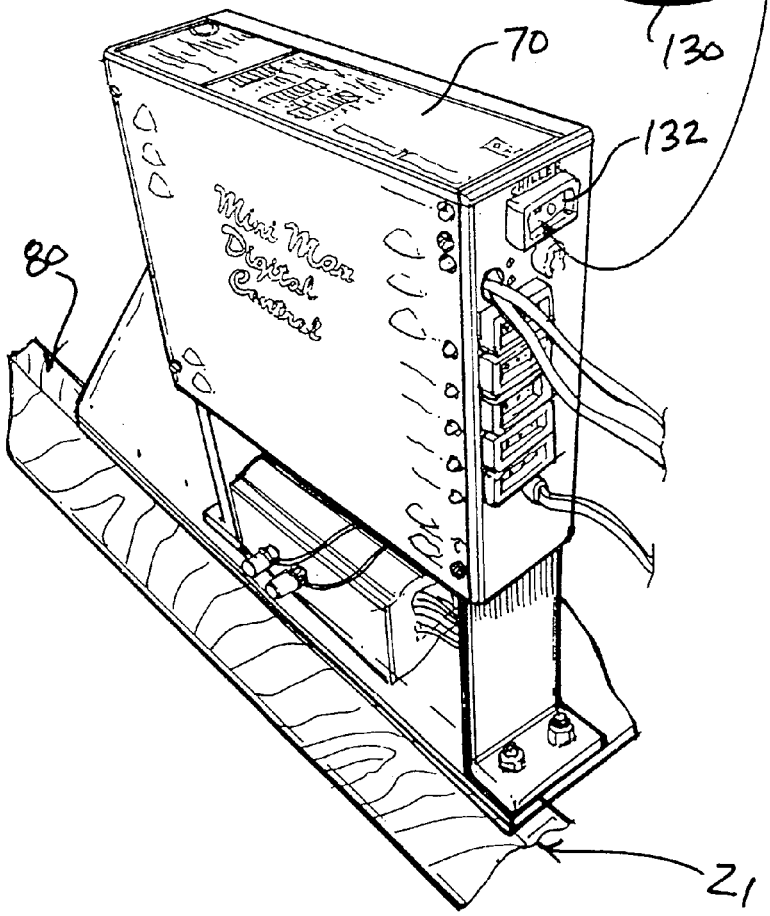
FIG. 10 is a perspective view of a controller of the spa system of FIG. 1.
Figure 11:
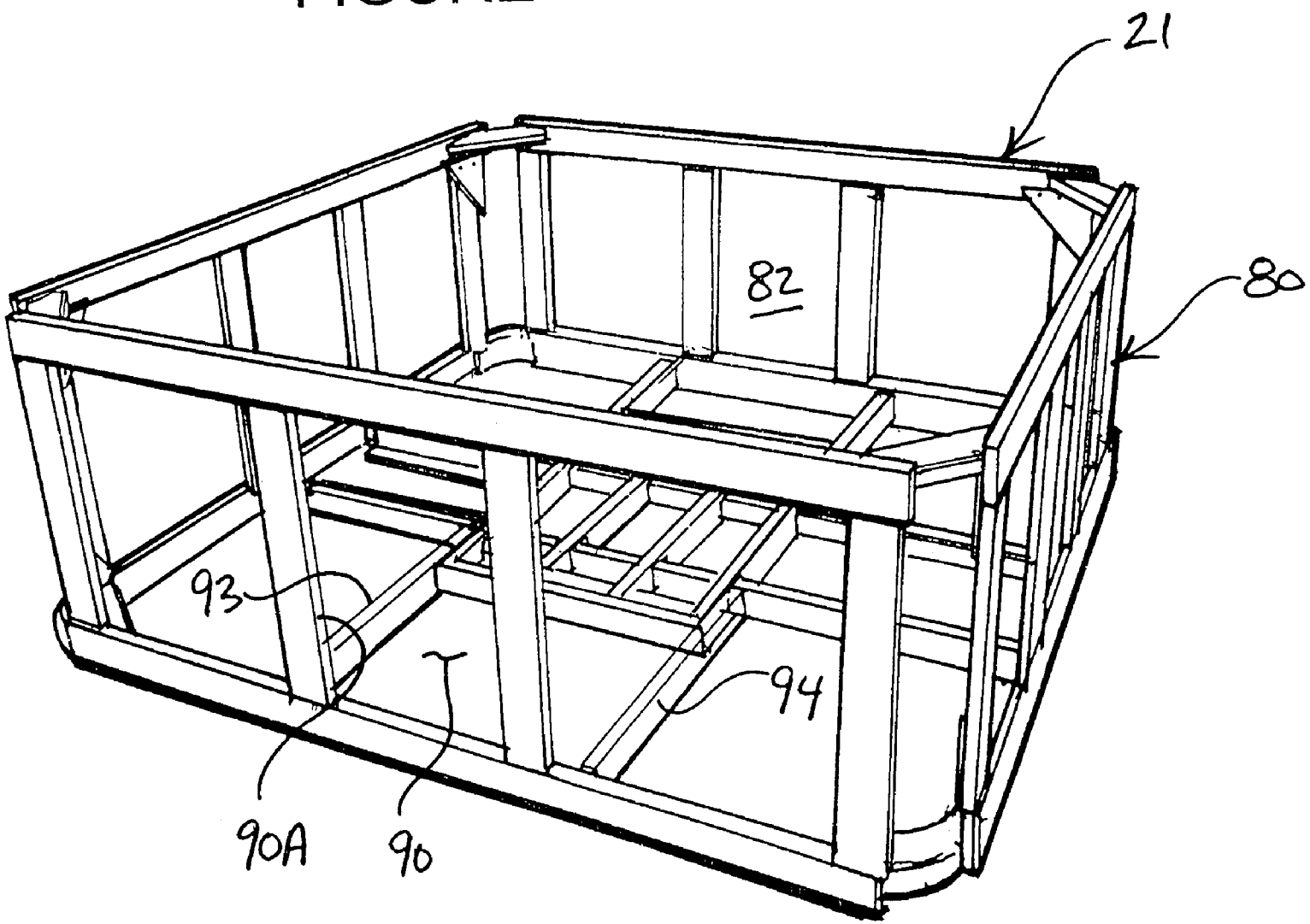
FIG. 11 is a perspective view of a chassis of the spa system of FIG. 1.

Cooling device 32 is provided with a plugged electrical interconnection 130. To complete the installation of cooling device 32, it must be operatively coupled to thermostat 45, which is accomplished by plugging the plugged end 131 of plugged electrical interconnection 130 to a corresponding port 132 formed in controller 70 as shown in FIG. 10. Plugging cooling device 32 into controller 70 is an easy and efficient way of operatively coupling cooling device 32 to thermostat 45. However, cooling device 32 may be hardwired to controller 70, if desired.

Cooling device 32 is normally mounted in place to frame 80 of chassis 21 at receiving area 90 before the installation of siding 81 is completed. Siding 81 typically consists of a series of siding panels, which are secured in place to frame 80 at the near or final completion of the construction of spa system 20. One of the siding panels constitutes a closure 135 (FIG. 5) for access opening 90A, which is secured to frame 80 with fasteners, such as screws or nails or the like, thereby enclosing access opening 90A forming part of chassis 21. A vent 136 is formed through closure 135, which leads to space 82 and is situated opposite fan 61 of cooling device 32. When fan 61 is activated concurrently with the activation of cooling device 32, the situation of fan 61 opposite vent 136 allows fan to draw outside air into enclosed space 82 through vent 136 to cool cooling device 32 so that it may operate properly and efficiently and not overheat or fail. If desired, an annular boot, frame, or other form of seal, such as the one designated generally at 137 in FIG. 5, may be applied between fan 61 of vent 136 for isolating the airflow therebetween.

As fan draws air into space 82, positive pressure can, however, build up in space 82, which may prevent the inflow of air into space 82 through vent 136 and thereby prevent cooling device 32 from being properly cooled. To eliminate the buildup of positive pressure in space 82 during the operation of cooling device 32, spa system 20 incorporates a blower 140, which is depicted in FIG. 2. Looking to FIG. 1, a vent 141 is formed in siding 81 of chassis 21 leading to space 82, and blower 140 is positioned opposite vent 141 as depicted schematically in FIG. 2. Blower 140 is coupled in electrical communication with controller 70. When controller 70 activates cooling device 32 to chill water passing through circulating system 30, in which case fan 61 is operational drawing air into space 82 through vent 136 across cooling device 32, controller 70 concurrently activates blower 140, which is then operative for blowing/expelling air from enclosed space 82 through vent 141 thereby preventing positive air pressure from building up in space 81, in accordance with the principle of the invention. When controller 70 deactivates cooling device 32, it concurrently deactivates blower 140.

In another embodiment, blower 140 is coupled in electrical communication with cooling device 32 via electrical interconnection 150 (FIGS. 4 and 6). In this embodiment, when controller 70 activates cooling device 32 to chill water passing through circulating system 30, in which case fan 61 is operational drawing air into space 82 through vent 136 across cooling device 32, cooling device 32 concurrently activates blower 140, which is thereby operative for expelling air from enclosed space 82 through vent 141 preventing positive air pressure from building up in space 81, in accordance with the principle of the invention. When cooling device 32 is deactivated, it concurrently deactivates blower 140. Any desired number of vents can be incorporated with chassis 21.

Although cooling device 32 is normally mounted in place to frame 80 of chassis 21 at receiving area 90 before the installation of siding 81 is complete, spa system 20 may be constructed and arranged leaving cooling device 32 out. In this respect, spa system 20 may be sold as unit without the provision of cooling device 32. However, because chassis 21 is structured and arranged with a receiving area 90 to accommodate cooling device 32, and because circulating system 30 passes into and through receiving area 90, cooling device 32 may be incorporated with spa system 20 at any time, in accordance with the principle of the invention. In other words, spa system 20 is specifically constructed and arranged so that it may be retrofitted with cooling device 32 at any time, as may be desired. To retrofit spa system 20 with cooling device 32, closure 135 is removed, cooling device 32 is taken up and set into receiving area 90 as previously described, plumbed to circulating system 30 passing through receiving area 90, and then operatively coupled to controller 70 with conventional electrical interconnections or plugs so that controller 70 will operate cooling device 32 as herein described, after which closure 135 is reattached thereby completing the installation of cooling device 32.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

Having fully described the invention in such clear and concise terms as to enable those skilled in the art to understand and practice the same, the invention claimed is:

1. A spa system, comprising:

a tub;

water heating and cooling devices operatively coupled in series to a water circulating system adapted to withdraw and return water relative to the tub to convey water from the tub in series first to one of the water heating and cooling devices and then to the other of the water heating and cooling devices and then back to the tub, the water heating device operative to heat water passing through the circulating system, and the water cooling device operative to chill water passing through the circulating system; and a thermostat operatively coupled to both the heating and cooling devices, the thermostat operative to control the operation of both the heating and cooling devices to set a desired temperature of water passing through the circulating system.

2. The spa system according to claim 1, further comprising:

a chassis supporting the tub;

a cooling device receiving area formed in the chassis; and the cooling device disposed at the cooling device receiving area.

3. The spa system according to claim 2, further comprising:

opposed first and second rails, carried by the chassis, disposed on either side of the cooling device receiving area;

a platform having opposed first and second sides received against the first and second rails, respectively, thereby supporting the platform at the cooling device receiving area; and the cooling device supported atop the platform.

4. The spa system according to claim 3, further comprising:

an access opening through the chassis leading to the cooling device receiving area; and a closure adapted to be secured to the chassis for enclosing the access opening.

5. A spa system, comprising:

a tub supported by a chassis;

a substantially enclosed space formed between the tub and the chassis;

first and second vents through the chassis leading to the enclosed space;

water heating and cooling devices operatively coupled in series to a circulating system adapted to withdraw and return water relative to the tub to convey water from the tub in series first to one of the water heating and cooling devices and then to the other of the water heating and cooling devices and then back to the tub, the water heating device operative to heat water passing through the circulating system, and the water cooling device operative to chill water passing through the circulating system;

a thermostat operatively coupled to both the heating and cooling devices, the thermostat operative to control the operation of both the heating and cooling devices to set a desired temperature of water passing through the circulating system;

the cooling device incorporating a fan operative for drawing air into the enclosed space through the first vent in response to activation of the cooling device to cool the cooling device; and a blower operative for expelling air from the enclosed space through the second vent concurrently with the operation of the fan of the cooling device.

6. The spa system according to claim 5, further comprising:

a cooling device receiving area formed in the enclosed space; and the cooling device disposed at the cooling device receiving area.

7. The spa system according to claim 6, further comprising:

opposed first and second rails, carried by the chassis, disposed on either side of the cooling device receiving area;

a platform having opposed first and second sides received against the first and second rails, respectively, thereby supporting the platform at the cooling device receiving area; and the cooling device supported atop the platform.

8. The spa system according to claim 7, further comprising:

an access opening through the chassis leading to the cooling device receiving area; and a closure adapted to be secured to the chassis for enclosing the access opening forming part of the chassis.

9. The spa system according to claim 8, wherein the first vent is formed in the closure.

10. A spa system, comprising:

a tub supported by a chassis;

a substantially enclosed space formed between the tub and the chassis;

first and second vents through the chassis leading to the enclosed space;

water heating and cooling devices operatively coupled in series to a circulating system adapted to withdraw and return water relative to the tub to convey water from the tub in series first to one of the water heating and cooling devices and then to the other of the water heating and cooling devices and then back to the tub, the water heating device operative to heat water passing through the circulating system, and the water cooling device operative to chill water passing through the circulating system;

the cooling device operatively coupled to a blower;

a thermostat operatively coupled to both the heating and cooling devices, the thermostat operative to control the operation of both the heating and cooling devices to set a desired temperature of water passing through the circulating system;

the cooling device incorporating a fan operative for drawing air into the enclosed space through the first vent in response to activation of the cooling device to cool the cooling device;

a blower activated by the cooling device in response to the activation thereof for expelling air from the enclosed space through the second vent.

11. The spa system according to claim 10, further comprising:

a cooling device receiving area formed in the enclosed space; and the cooling device disposed at the cooling device receiving area.

12. The spa system according to claim 11, further comprising:

opposed first and second rails, carried by the chassis, disposed on either side of the cooling device receiving area;

a platform having opposed first and second sides received against the first and second rails, respectively, thereby supporting the platform; and the cooling device supported atop the platform.

13. The spa system according to claim 12, further comprising:

an access opening through the chassis leading to the cooling device receiving area; and a closure adapted to be removably secured to the chassis for enclosing the access opening.

14. The spa system according to claim 13, wherein the first vent is formed in the closure.

15. In a spa system including a tub supported by a chassis, a substantially enclosed space formed between the tub and the chassis, and a water heater operatively coupled to a circulating system adapted to withdraw and return water relative to the tub, improvements therein comprising:

a water cooling device operatively coupled to the circulating system in series with the water heater to convey water from the tub in series first to one of the water heating and cooling devices and then to the other of the water heating and cooling devices and then back to the tub, the water cooling device operative to chill water passing through the circulating system; and a thermostat operatively coupled to both the heating and cooling devices, the thermostat operative to control the operation of both the heating and cooling devices to set a desired temperature of water passing through the circulating system.

16. The improvements according to claim 15, further comprising:

first and second vents through the chassis leading to the enclosed space;

the cooling device incorporating a fan operative for drawing air into the enclosed space through the first vent in response to activation of the cooling device; and a blower operative for expelling air from the enclosed space through the second vent concurrently with the operation of the fan of the cooling device.

17. The improvements according to claim 16, further comprising:

a cooling device receiving area formed in the enclosed space; and the cooling device disposed at the cooling device receiving area.

18. The improvements according to claim 17, further comprising:

opposed first and second rails, carried by the chassis, disposed on either side of the cooling device receiving area;

a platform having opposed first and second sides received against the first and second rails, respectively, thereby supporting the platform at the cooling device receiving area; and the cooling device supported atop the platform.

19. The improvements according to claim 18, further comprising:

an access opening through the chassis leading to the cooling device receiving area; and a closure adapted to be removably secured to the chassis for enclosing the access opening forming part of the chassis.

20. The improvements according to claim 19, wherein the first vent is formed in the closure.

* * * * *